US005203042A

United States Patent [19]

Mason

[11] Patent Number: 5,203,042

[45] Date of Patent: Apr. 20, 1993

[54] BED COVER LIFT APPARATUS

[76] Inventor: Arthur L. Mason, 369 E. 33rd St., Paterson, N.J. 07504

[21] Appl. No.: 905,328

[22] Filed: Jun. 29, 1992

[51] Int. Cl.[5] ..... A47C 21/00

[52] U.S. Cl. ..... 5/504.1; 5/505.1

[58] Field of Search ..... 5/498, 504.1, 505.1, 5/506.1

[56] References Cited

U.S. PATENT DOCUMENTS

| | | | |
|---|---|---|---|
| 2,210,255 | 8/1940 | Peevey | 5/505.1 |
| 2,602,171 | 7/1952 | Good | 5/505.1 |
| 2,614,269 | 10/1952 | Hougham | 5/505.1 |
| 2,674,750 | 4/1954 | Moore | 5/505.1 |
| 3,808,614 | 5/1974 | Reinhard | 5/505.1 |
| 4,214,327 | 7/1980 | Smith | 5/504.1 X |
| 4,975,997 | 12/1990 | Misiura et al. | 5/505.1 |

*Primary Examiner*—Michael F. Trettel
*Attorney, Agent, or Firm*—Leon Gilden

[57] ABSTRACT

An elongate framework is arranged for mounting to opposed sides of a bed assembly, with the framework including spaced, parallel first and second support members extending coextensively relative to one another, having a support plate mounted orthogonally to the first suppot member telescopingly received within a support sleeve orthogonally mounted to the second support member, with the support plate and the support sleeve longitudinally aligned. Clip structure is arranged for securement of the frame assembly to an underlying mattress permitting positioning and spacing of a cover structure of a bed in a spaced relationship relative to the underlying mattress.

3 Claims, 4 Drawing Sheets

BED COVER LIFT APPARATUS

BACKGROUND OF THE INVENTION

1. Field of the Invention

The field of invention relates to bed cover lifting structure, and more particularly pertains to a new and improved bed cover lift apparatus wherein the same permits spacing of cover structure relative to a mattress relative to an individual's feet.

2. Description of the Prior Art

Individual's having sensitized feet due to various physical ailments such as frost bite, skin burning, and the like have sensitized feet and wherein to prevent contact of the blanket structure relative to the individual's feet or portions of the individual's body, various lift structure is available in the prior art. Such lift structure is exemplified in the U.S. Pat. No. 4,493,121 to Williams having an overlying framework having a line member arranged to lift a cover relative to an individual's feet.

U.S. Pat. No. 4,644,599 to Wolcott sets forth a bed cover lift wherein a framework spaces a cover structure relative to an individual.

U.S. Pat. No. 4,852,598 to Griesenbeck sets forth a bed tent spacing a tent structure relative to an underlying bed.

As such, it may be appreciated there continues to be a need for a new and improved bed cover lift apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bed cover lift apparatus now present in the prior art, the present invention provides a bed cover lift apparatus wherein the same is arranged to provide for a framework providing for support of a bed cover structure to support the cover structure in a spaced relationship relative to an individual's feet. As such, the general purpose of the present invention, which will be described subsequently in greater detail, is to provide a new and improved bed cover lift apparatus which has all the advantages of the prior art bed cover lift apparatus and none of the disadvantages.

To attain this, the present invention provides an elongate framework arranged for mounting to opposed sides of a bed assembly, with the framework including spaced, parallel first and second support members extending coextensively relative to one another, having a support plate mounted orthogonally to the first support member telescopingly received within a support sleeve orthogonally mounted to the second support member, with the support plate and the support sleeve longitudinally aligned. Clip structure is arranged for securement of the frame assembly to an underlying mattress permitting positioning and spacing of a cover structure of a bed in a spaced relationship relative to the underlying mattress.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed cover lift apparatus which has all the advantages of the prior art bed cover lift apparatus and none of the disadvantages.

It is another object of the present invention to provide a new and improved bed cover lift apparatus which may be easily and efficiently manufactured and marketed.

It is a further object of the present invention to provide a new and improved bed cover lift apparatus which is of a durable and reliable construction.

An even further object of the present invention is to provide a new and improved bed cover lift apparatus which is susceptible of a low cost of manufacture with regard to both materials and labor, and which accordingly is then susceptible of low prices of sale to the consuming public, thereby making such bed cover lift apparatus economically available to the buying public.

Still yet another object of the present invention is to provide a new and improved bed cover lift apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
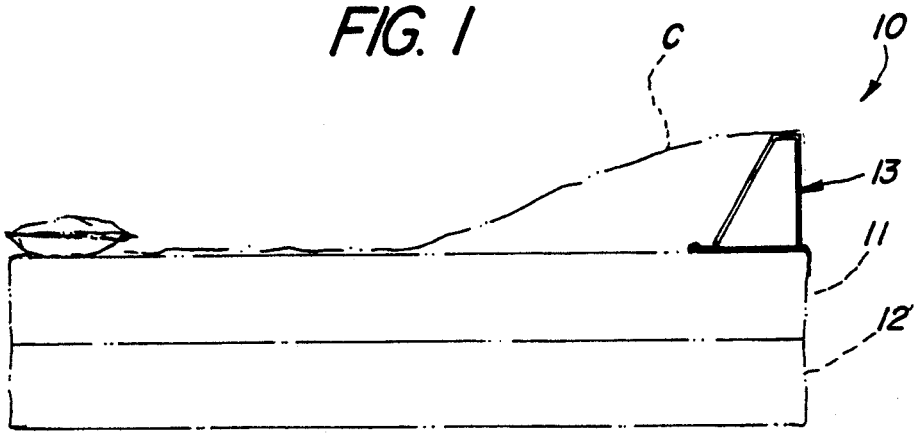
FIG. 1 is an orthographic view of the invention mounted relative to an associated bed assembly.
Figure 2:
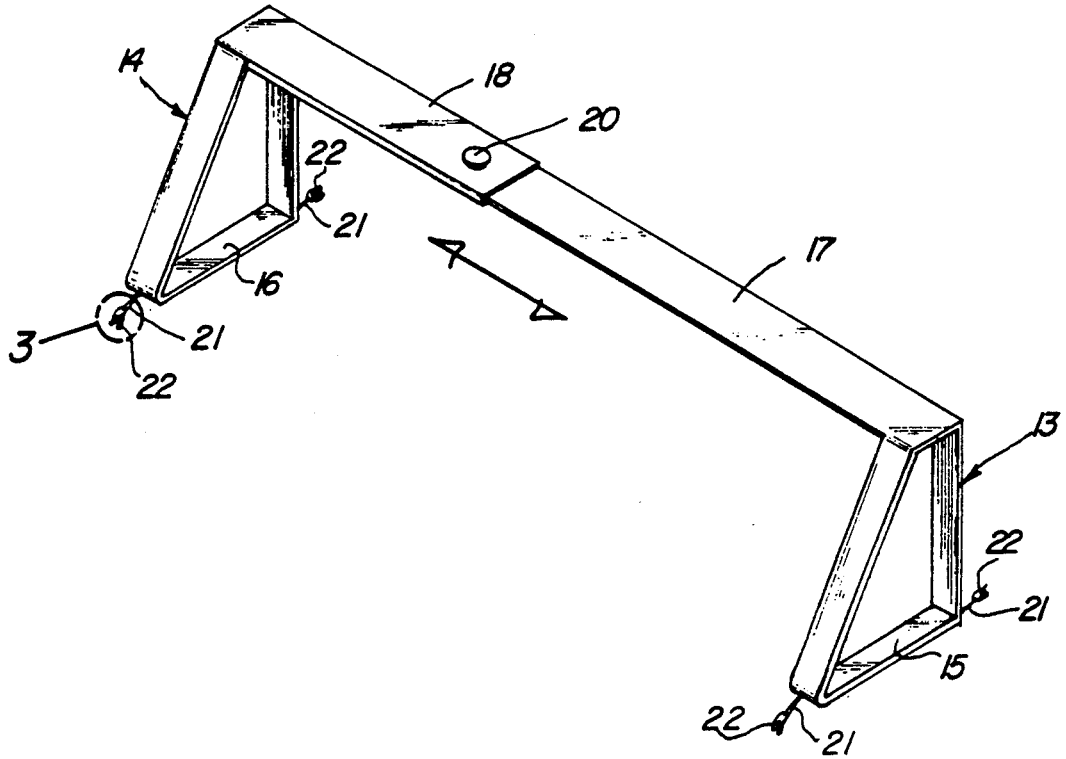
FIG. 2 is an isometric illustration of the invention.
Figure 3:
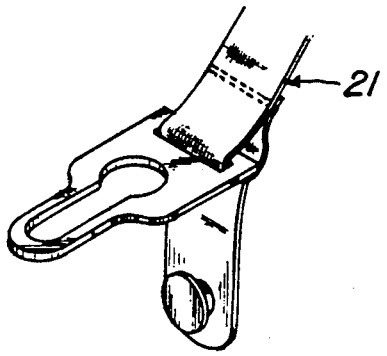
FIG. 3 is an isometric illustration of section 3 as set forth in FIG. 2.
Figure 4:
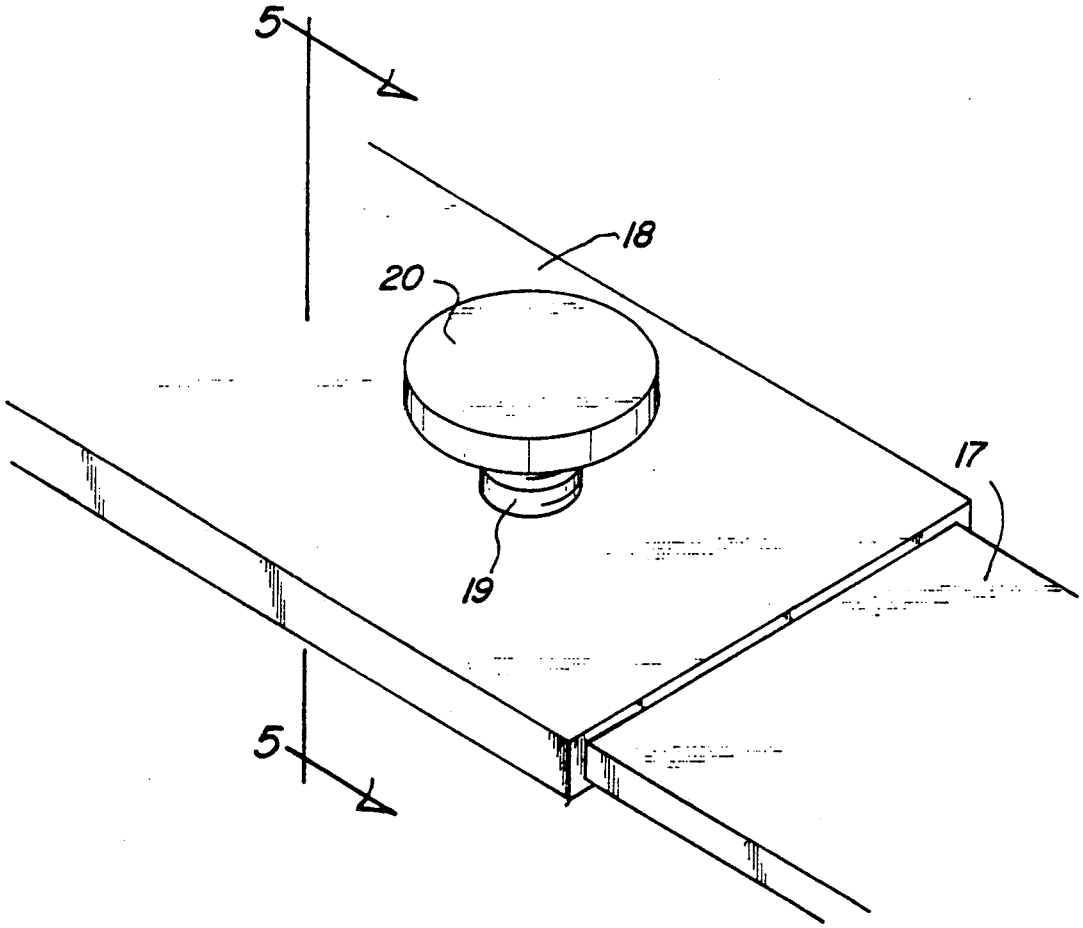
FIG. 4 is an enlarged isometric illustration of the reception of the support plate relative to the support sleeve.

With reference now to the drawings, and in particular to FIGS. 1 to 8 thereof, a new and improved bed cover lift apparatus embodying the principles and concepts of the present invention and generally designated by the reference numeral 10 will be described.

Figure 5:
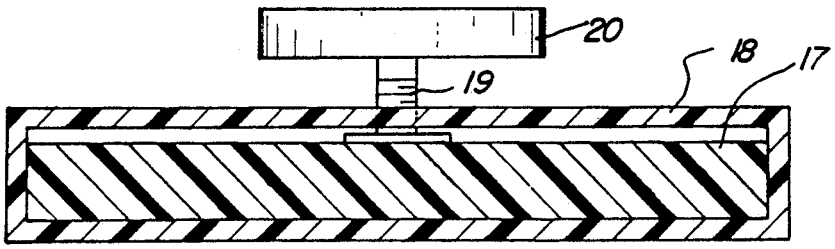
FIG. 5 is an orthographic view, taken along the lines 5—5 of FIG. 4 in the direction indicated by the arrows.

More specifically, the bed cover lift apparatus 10 of the instant invention essentially comprises mounting to a bed assembly having a bed mattress member 11 and a bed box spring member 12 positioned below and supporting the mattress member 11 in a generally coextensive relationship. The lift apparatus includes a first support member 13 spaced from, parallel to, and coextensive relative to a second support member 14. The first support member 13 includes a first base leg 15, with the second support member 14 having a second base leg 16, wherein the first and second base legs 15 and 16 respectively are arranged in a coplanar and coextensive relationship. A longitudinally aligned support plate 17 is orthogonally mounted to the first support member 13 at an upper distal end thereof parallel to and above the first base leg. The support plate 17 is telescopingly and slidably received within a support sleeve 18 that in turn is fixedly mounted to the second support member 14 in an orthogonal relationship with the support sleeve 18 arranged parallel relative to the second base leg 16, as well as the first base leg 15. A lock rod 19 threadedly directed through the support sleeve 18 engages the support plate 17 within the support sleeve 18. A lock rod handle 20 at an upper end of the lock rod 19 permits ease of manual rotation of the lock rod 19 through the support sleeve to permit for selective securement of the support plate relative to the support sleeve 18, in a manner as illustrated in FIG. 5 for example. Each base leg includes a plurality of elastomeric straps 21 extending exteriorly of each base leg at each end thereof. A clip member 22 is mounted to each elastomeric strap 21 spaced from an associated base leg, wherein the clip member 22 is arranged for securement to the associated mattress member 11, and typically to a cover sheet thereof.

Figure 6:
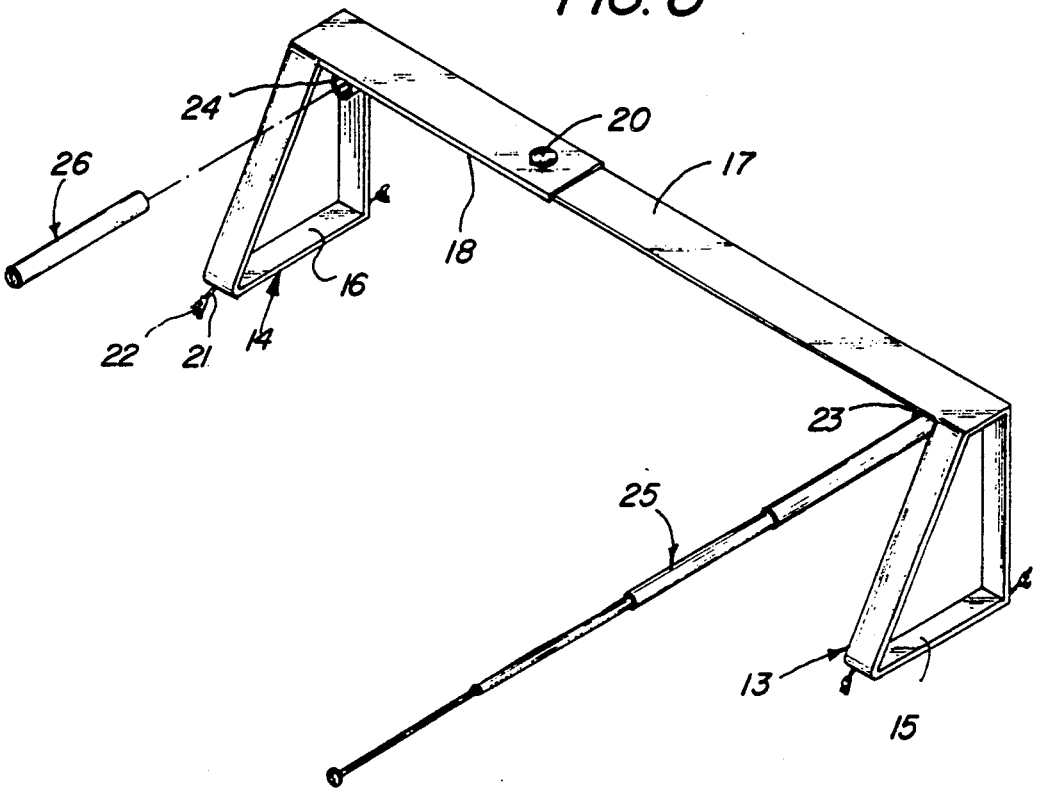
FIG. 6 is an isometric illustration of the apparatus including telescoping rods to support adjustably various lengths of a bed cover relative to an individual.

The FIG. 6 indicates the use of a first and second support tube 23 and 24 respectively fixedly mounted to a bottom surface of the support plate 17 and the support sleeve 18 respectively at an intersection of the support plate 17 relative to the first support member 13 and the support sleeve 18 relative to the second support member 14. The support tubes 23 and 24 are arranged in a parallel relationship relative to one another and parallel to the first and second base legs 15 and 16. The first support tube 23 mounts a first telescoping rod assembly 25 formed of a plurality of first telescoping members, and a second telescoping rod assembly 26 mounted within a second support tube 24. As illustrated, the first and second telescoping rod assemblies 25 and 26 are arranged in a parallel relationship relative to one another and to the base legs 15 and 16. In this manner, a cover assembly "C", as illustrated in FIG. 1, may be spaced above an individual at various spacings relative to the support plate 17 and the support sleeve 18, as required, to space the cover structure relative to the individual.

Figure 7:
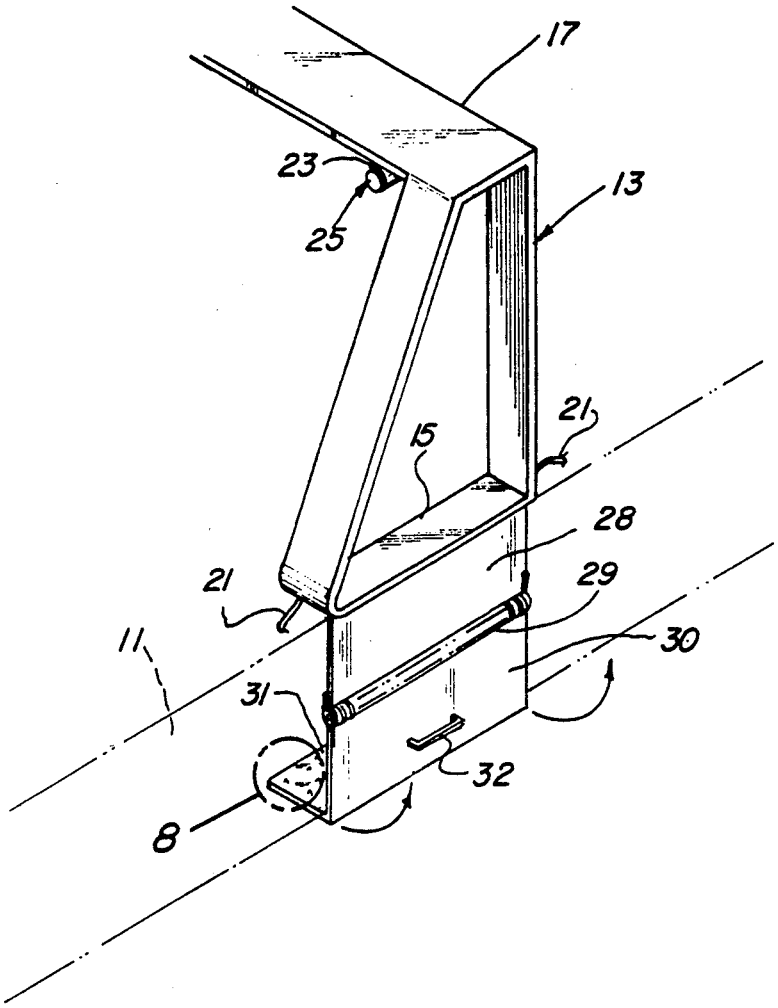
FIG. 7 is an isometric illustration of the invention including a mattress mounting flange structure.
Figure 8:
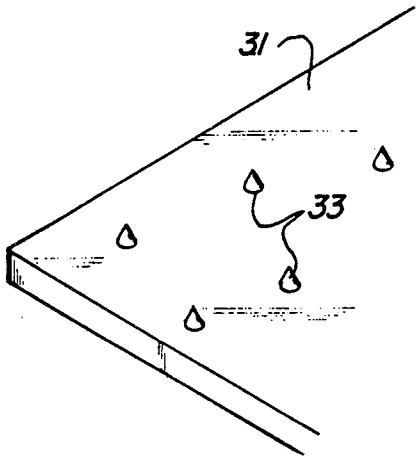
FIG. 8 is an enlarged isometric illustration of section 8 as set forth in FIG. 7.

The FIGS. 7 and 8 further indicate the use of a support plate assembly mounted to each of the base legs, wherein for purposes of illustration, its mounting relative to the first base leg 15 is illustrated, wherein it is understood that an identical mirror image configuration is mounted to the second base leg 16. Each support assembly includes a first plate 28 mounted to a respective base leg orthogonally and downwardly thereof in integral association therewith. The first plate 28 includes a lower edge mounting a spring hinge 29 that is oriented parallel relative to the base leg, and the spring hinge 29 mounts a second plate 30 in a biased coplanar relationship relative to the first plate 28. The spring hinge 29 permits displacement of the second plate 30 relative to the first plate 28 to permit insertion of a third plate 31 between the mattress member 11 and the box spring 12. The third plate 31 is orthogonally mounted to the second plate 30 at a lower edge of the second plate 30 spaced from the spring hinge 29. As illustrated in FIG. 8, a plurality of resilient projections 33 project upwardly of each third plate 31 for engagement with a bottom surface of the associated mattress member 11 to enhance engagement therewith. A handle 32 is mounted to the second plate 30 for ease of manual manipulation of the second and third plates 30 and 31 relative to the first plate 28 about the spring hinge 29.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bed cover lift apparatus arranged for mounting onto a bed assembly, wherein the bed assembly includes a mattress member and a box spring member, with the mattress member positioned over and in contiguous communication with the box spring member, and wherein the apparatus comprises, a first support member spaced from and parallel to a second support member in a coextensive relationship, the first support member having a first base leg, the second support member having a second base leg, wherein the first base leg and the second base leg are arranged in a coplanar coextensive relationship, and a longitudinally aligned support plate fixedly and orthogonally mounted to the first support member parallel to the first base leg, and the second support member having a support sleeve fixedly and orthogonally mounted to the second support member parallel to the second base leg, wherein the support sleeve slidably receives the support plate, and wherein the support plate is mounted to an upper distal end of the first support member, and the support sleeve is mounted to an upper distal end of the second support member, and a lock rod is threadedly and orthogonally directed through the support sleeve, wherein the lock rod includes a lower end arranged for engagement with the support plate, wherein the lower end is positioned within the support sleeve, and the lock rod including an upper end, wherein the upper end includes a lock rod handle permitting ease of manual manipulation of the lock rod, and the first base leg and the second base leg each include a plurality of elastomeric straps extending from the respective first base leg and second base leg, and each elastomeric strap includes a clip member arranged for securement to the mattress member.

2. An apparatus as set forth in claim 1 including a first support tube fixedly mounted to the support plate below the support plate at an intersection of the support plate and the support member, and a second support tube, the second support tube is fixedly mounted to the support sleeve to a bottom surface of the support sleeve at an intersection of the support sleeve and the second support member, wherein the first support tube and the second support tube are arranged in a parallel relationship relative to one another, and the first support tube includes a first telescoping rod assembly, including a plurality of first telescoping rods, and the second support tube includes a second telescoping rod assembly having a plurality of second telescoping rods, wherein the first telescoping rod assembly and the second telescoping rod assembly are parallel relative to one another to support a bed cover thereon of said bed assembly.

3. An apparatus as set forth in claim 2 wherein the first base leg and the second base leg each include a first plate integrally and orthogonally mounted and extending below the first base leg and the second base leg, and the first plate including a lower edge, and each lower edge includes a spring hinge, and each spring hinge is oriented parallel to the first base leg and the second base leg, and the spring hinge includes a second plate, wherein the second plate is biased in a coplanar relationship to the first plate in a first position and is arranged for angular displacement relative to the first plate in a second position, with a handle mounted to the second plate, and a third plate mounted to each lower edge of each second plate, wherein the third plate is parallel to the spring hinge, and the third plate includes a third plate top surface to receive the mattress member thereon, and the third plate top surface includes a plurality of resilient projections extending above the third plate top surface to enhance frictional engagement with the mattress member.

* * * * *